US005186643A

United States Patent [19]

Bakke et al.

[11] Patent Number: 5,186,643

[45] Date of Patent: Feb. 16, 1993

[54] LATCHING DEVICE FOR AN EDGE CONNECTOR

[75] Inventors: Patrick D. Bakke, Naperville; David C. Bowen, Downers Grove, both of Ill.

[73] Assignee: Molex Incorporated, Lisle, Ill.

[21] Appl. No.: 762,698

[22] Filed: Sep. 19, 1991

[51] Int. Cl.[5] ..... H01R 13/62

[52] U.S. Cl. ..... 439/326

[58] Field of Search ..... 439/296, 326–328, 439/629–637

[56] References Cited

U.S. PATENT DOCUMENTS 4,826,446 5/1989 Juntwait ..... 439/326

4,850,891 7/1989 Walkup et al. ..... 439/326

*Primary Examiner*—Joseph H. McGlynn

*Attorney, Agent, or Firm*—Charles S. Cohen

[57] ABSTRACT

An edge connector is disclosed for a printed circuit board having a mating edge and a plurality of contact pads adjacent the edge. The connector includes an elongated insulating housing having a plurality of contacts mounted on the housing along the length thereof for engaging the printed circuit board contact pads when the printed circuit board is inserted into the housing at a first angular position and subsequently pivoted to a second angular position. The contacts exert an opposing force against the printed circuit board when pivoted to the second angular position. A latching device has a latching section for engaging the printed circuit board. The latching device is rotatably mounted on the housing for rotation from a first position to a second position in response to pivoting the printed circuit board from its first angular position to its second angular position. The latching device is linearly moveable from its second position to a third locking position under the influence of the opposing force of the spring contacts. Complementary interengaging latching surfaces are provided between the latching device and the housing for automatically locking the printed circuit board to the housing when the latching device moves to its third locking position.

18 Claims, 2 Drawing Sheets

10
12
14
16
18
20
22
24
26
28
30
32
34
36
56
58
70
72
A

LATCHING DEVICE FOR AN EDGE CONNECTOR

FIELD OF THE INVENTION

This invention generally relates to the art of electrical connectors and, particularly, to a latching device for an edge connector which receives a printed circuit board.

BACKGROUND OF THE INVENTION

Zero insertion force edge connectors are known for providing low insertion force to make electrical connections between contact pads along an edge of a printed circuit board with spring contacts mounted on or in an elongated insulating housing. The housing is recessed or has a cavity formed along its length with an opening for receiving the printed circuit board mating edge. In one particular type, the spring contacts mounted in the housing engage the printed circuit board contact pads when the printed circuit board is inserted at a first angular position and subsequently pivoted to a second angular position. An example of such a zero insertion force edge connector is shown in U.S. Pat. No. 4,575,172 to Walse et al., dated Mar. 11, 1986 and assigned to the assignee of this invention.

Many such edge connectors include latching means for engaging the printed circuit board. Most often, the latching means include latch members with resilient characteristics required in order to allow the latch members to cooperate with the printed circuit board to maintain the board in electrical engagement with the spring contacts of the connector.

This invention is directed to providing an improved mechanism for such zero insertion force edge card connectors.

SUMMARY OF THE INVENTION

An object, therefore, of the invention is to provide a new and improved latching means for an edge connector which receives a printed circuit board having a mating edge and a plurality of contact pads adjacent the edge.

In the exemplary embodiment of the invention, the edge connector includes an elongated insulating housing have a plurality of spring contacts mounted on the housing along the length thereof for engaging the printed circuit board pads when the printed circuit board is inserted into the housing at a first angular position, subsequently pivoted to a second angular position and then to a third angular position. The spring contacts exert an opposing force against the printed circuit board when pivoted to the second and third angular positions. A latching device has a latching section for engaging the printed circuit board. The latching device is rotatably mounted on the housing for rotation from a first position to a second position in response to pivoting the printed circuit board from the first angular position to the second angular position. The latching device is linearly movable from the second position to a third locking position under the influence of the opposing force of the spring contacts which forces the printed circuit board from the second angular position to the third angular position. Complementary interengaging latching means are provided between the latching device and the housing for locking the printed circuit board to the housing when the latching device moves to the third locking position.

As disclosed herein, the housing is integrally molded of dielectric material, and the latching device is provided in the form of a one-piece molded dielectric block. Generally, the complementary interengaging latching means is provided by interengaging surface means between the one-piece latching block and an integral portion of the housing.

Specifically, the latching block is rotatable about a pivot post integral with the housing. The block includes an aperture for receiving the pivot post. The aperture is elongated with a rounded pivot section at one end and a locking surface section at an opposite end. The pivot post has a rounded portion on one side thereof for rotating in the rounded pivot section of the aperture when the latching block rotates between the aforesaid first and second positions. The pivot post has a locking surface portion on an opposite side for engaging the locking surface section of the aperture when the latching block is in the third locking position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figures 1, 1A:
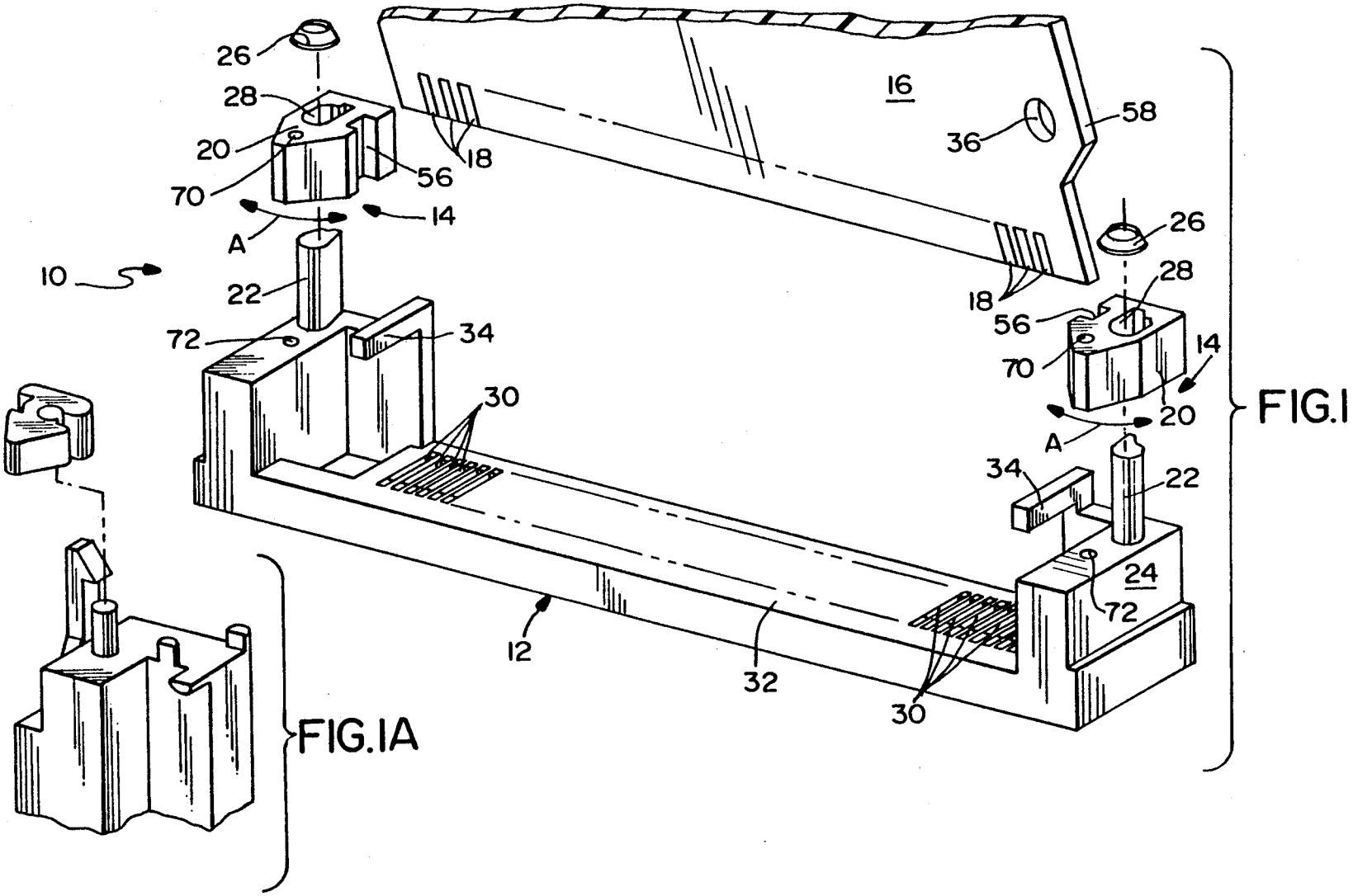
FIG. 1 is an exploded perspective view of an edge connector employing the novel latching means of the invention.
FIG. 1A is a fragmented, exploded perspective view of an alternative latching mechanism of the edge connector of FIG. 1.

Referring to the drawings in greater detail, and first to FIG. 1, the invention is embodied in an edge card connector, generally designated 10, which includes an elongated insulating housing, generally designated 12, integrally molded of dielectric material such as plastic or the like. The housing includes latch means, generally designated 14, at each opposite end thereof for interengagement with and latching a printed circuit board 16 in a position with contact pads 18 on the board interconnected with spring contacts (not shown in FIG. 1) mounted on the housing. Each latching means 14 includes a one-piece latching block 20 rotatably mounted on a pivot post 22 integrally molded with and projects upwardly from an end wall 24 of housing 12. A spring-locking washer 26 is fixed to the top of each pivot post 22 to retain latching blocks 20 on the posts.

In addition to upstanding pivot posts 22, integrally molded housing 12 includes a plurality of receptacles 30 in a base 32 thereof for mounting a plurality of spring contacts 37, as seen and described hereinafter in relation to FIGS. 4 and 5. The housing also includes a pair of horizontal guide posts 34, one at each opposite end of the housing, for insertion into holes 36 in printed circuit board 16 to properly position and retain the printed circuit board within the housing so that contact pads 18 on the board properly engage the contacts mounted on the housing.

Figure 2:
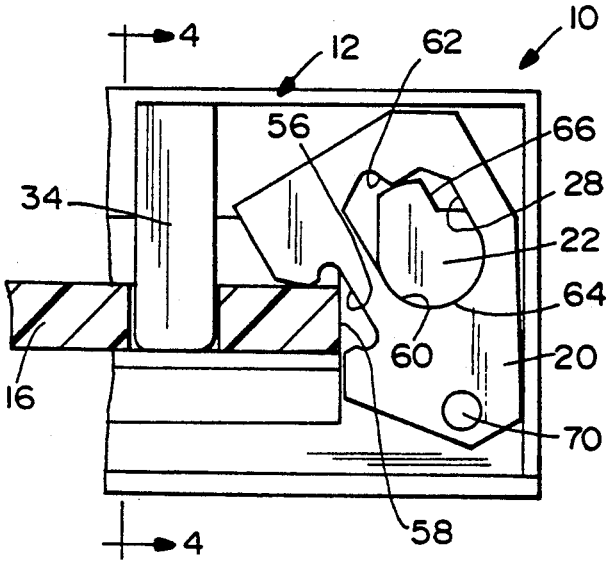
FIG. 2 is a fragmented top plan view of the right hand latching device (as viewed in FIG. 1) in its first position for receiving a printed circuit board in a first angular position.
Figure 4:
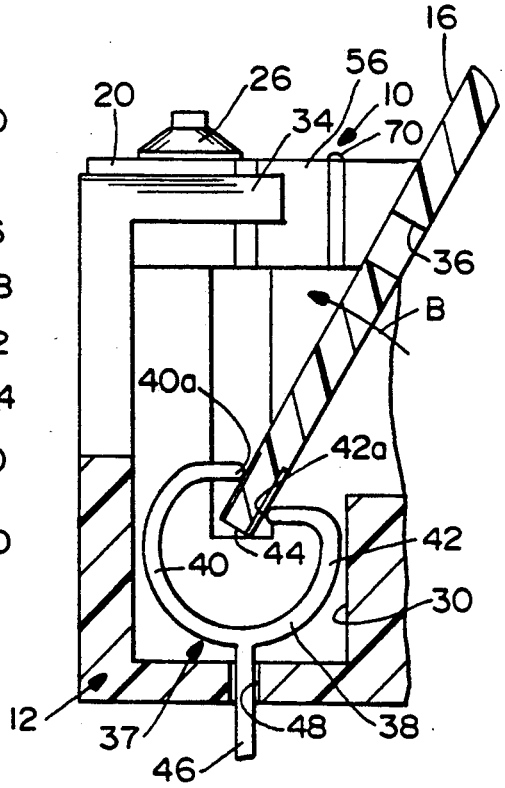
FIG. 4 is a vertical section taken generally line 4—4 of FIG. 2 but showing the printed circuit board immediately after insertion into the contacts.
Figure 3:
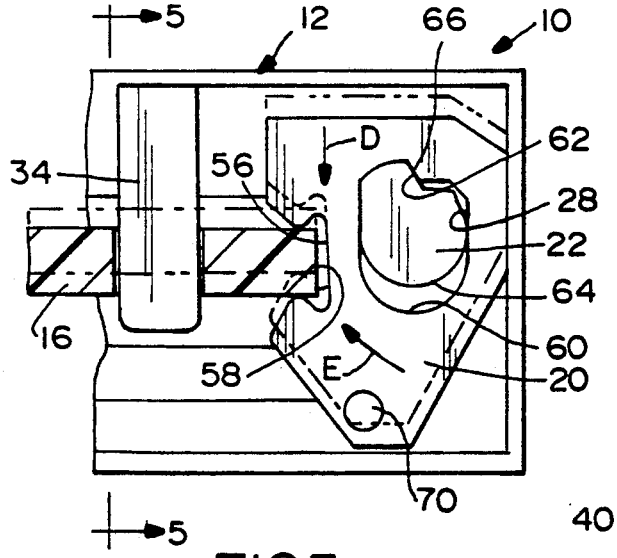
FIG. 3 is a view similar to that of FIG. 2, with the printed circuit board its latched position and the latching device in its full locking condition.
Figure 5:
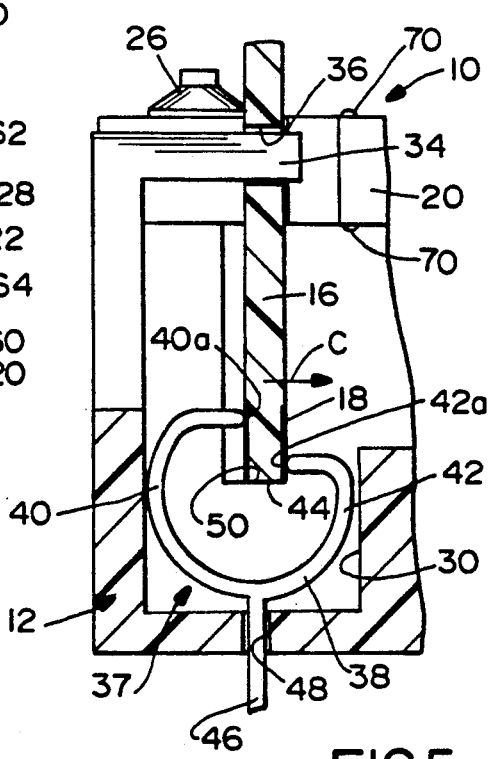
FIG. 5 is a vertical section taken generally along line 5—5 of FIG. 3.

Referring to FIGS. 2–5, edge card connector 10 is of the type described above in relation to U.S. Pat. No. 4,575,172 wherein printed circuit board 16 is inserted into the housing at a first angular position (FIG. 4) and subsequently pivoted to a second angular position (FIGS. 3 and 5). A plurality of contacts, generally designated 37 (FIGS. 4 and 5), are mounted in receptacles 30 in housing 12 along the length of the housing.

Each contact 37 has a rounded, continuously curved, generally C-shaped portion 38 with two opposed beam sections 40 and 42 which have free ends **40*a* and 42*a* defining resilient contacting portions for respectively contacting conductive contact pads 18 disposed along opposite sides of an insertable edge 44 of printed circuit board 16. A leg 46 extending from C-shaped portion 38 extends through a hole 48 in housing 12 for insertion into a corresponding hole in a printed circuit board for soldering to a circuit trace on the board or in the board hole. By disposing resilient contacting portions 40*a* and 42*a* at different elevations as shown in the drawings, printed circuit board 16 may be inserted at an angle (FIG. 3) to a preliminary contact position. In this manner, low or zero insertion force is required to insert edge 44 into the contacts, thereby minimizing undesirable wear on contact pads 18 and contacting portions 40*a* and 42*a***.

Once in its preliminary insertion position, printed circuit board 16 may be pivoted or rotated in the direction of arrow "B" (FIG. 4) until it assumes a final contact position (FIG. 5) in which edge 44 of printed circuit board 16 rests on a surface 50 of housing 12 in this final contact position. Contacting portions **40*a* and 42*a* are resiliently deflected outwardly relative to each other by their respective engagement with contact pads 18. The configuration of C-shaped portion 38 and its contacting portions 40*a* and 42*a* provides a relatively high contact force between the contacting portions and the printed circuit board contact pads and effectively exerts a force in the direction of arrow "C" (FIG. 5) which is opposite the pivoting direction "B" of the printed circuit board 16 from the angular position shown in FIG. 4 to the angular position shown in FIG. 5. It should be noted that upon rotating board 16, hole 36 in the printed circuit board has moved onto horizontal post 34 of housing 12**.

With the above-described insertion action of printed circuit board 16 in relation to FIGS. 4 and 5, the construction and operation of latching devices 14 (FIG. 1) can be better understood. More particularly, referring to FIGS. 2 and 3, each latching block 20 (the right-hand block from FIG. 1 being depicted in FIGS. 2 and 3) includes a notch 56 in the inside surface thereof for receiving a side edge 58 of printed circuit board 16. The notch defines a latching section for engaging the printed circuit board. Aperture 28 in latching block 20 is elongated and has a rounded pivot section 60 at one end and a locking surface section in the form of a step configuration 62 at an opposite end. Pivot post 22 has a rounded portion 64 on one side thereof about which rounded pivot section 60 of the aperture rotates and a locking projection portion 66 on an opposite side thereof for engagement behind step 62 within aperture 28. Latching block 20 is dimensioned to move linearly or forwardly in the direction of arrow "D" relative to pivot post 22 to bring locking step 62 and projection 66 into locking or latching engagement, with rounded pivot section 60 of aperture 28 in the latching block being moved off of rounded portion 64 on the outside of pivot post 22.

Each latching block 20 includes a dimple or projection 70 on the bottom surface thereof and the top surface of endwall 24 includes a recess 72 dimensioned to receive the dimple 70 in an interference fit to lock the latching block in an open position. The latching block as disclosed herein can be used for both the right and left side of the connector and therefore the dimples 70 are provided on both the top and bottom surfaces of the block 20.

With the above understanding of the cooperating structure and relative pivoting and linear movement of latching block 20 relative to pivot post 22, the operation of the latching means in cooperation with the insertion motion of printed circuit board 16 now will be described. Specifically, the connectors are initially assembled with the latching blocks 20 positioned as shown in FIG. 2 with the dimples 70 positioned over recess 72. Printed circuit board 16 is inserted into contacts 37 in the first angular position shown in FIG. 4. Upon rotation of printed circuit board 16 from its first angular position (FIG. 3) to its second angular position (shown in phantom in FIG. 5), side edges 58 of the printed circuit board move into notches 56 in latching blocks 20 and latching blocks 20 rotate in the direction of arrow "E" (FIG. 4) from a first position to a second position as rounded pivot section 60 of aperture 28 freely rotates about rounded portion 64 of pivot post 22.

Once printed circuit board 16 is rotated in the direction of arrow "B" (FIG. 3) to its second angular position contacts 37 are effective to exert an opposite force on the printed circuit board in the direction of arrow "C" (FIG. 5). This force causes the printed circuit board to rotate from its second angular position to its third angular position (FIG. 5) which forces latching blocks 20 to slide slightly in the direction of arrow "D" (FIG. 3) to its third position whereupon locking step 62 in aperture 28 of each latching block moves into locking engagement behind projection 66 on the outside of pivot post 22. Therefore, latching blocks 20 cannot rotate opposite the direction of arrow "E" (FIG. 3) and the printed circuit board is latched or locked in its final contacting position and maintained in that position due to the rotational forces of contacts 37 that bias block 20 in its locked position.

The above-described locking or latching action is effected automatically in response to printed circuit board 16 being inserted into the spring contacts and rotated to its final contacting position. It should be noted that essentially no insertion force is required for inserting the side edges 58 of the printed circuit board into notches 56 in the rotatable latching blocks 20. In addition, with the latching blocks being freely rotatable about pivot posts 22, there is no resiliency in the latching means of the invention against which the printed circuit board must oppose. Consequently, practically no wear is caused between the latching means of the invention and the printed circuit board.

In order to remove the printed circuit board from connector 10, an operator pushes latching blocks 20 inwardly, opposite the direction of arrow "D" (FIG. 3), which moves rounded portion 60 of aperture 28 back into rounded section 64 of post 22, simultaneously disengaging projection 66 of the pivot post from step 62 within aperture 28, and the printed circuit board 16 is then free to be pivoted opposite the direction of arrow "B" and easily removed from the connector.

FIG. 1A shows an alternate locking mechanism, generally designated 80, that could be used in place of latch means 14. Block 82 is shaped similarly to latching block 20 (FIG. 1) except that it does not include locking step 62. In addition, post 84 is identical to post 22 except it does not include the locking projection 66. Block 82 also includes a recess 86 located on its outer surface. A resilient latching arm 88 is provided to engage recess 86 to secure block 82 in a latched position after the board 16 is inserted and rotated into its locked position. The resilient latching arm 88 could be formed integrally with end wall 24 or could be a separate component.

Without the locking step 62 and locking projection 66, block 82 is free to rotate on post 84 if arm 88 is not engaging recess 86. Accordingly, once board 16 is secured within the connector 10, removal can be affected by moving arms 88 away from the board 16 and out of recess 86. The forces "C" will then rotate board 16 as well as blocks 82 to their initial, unlocked position. Projections 90 and 92 act as stops to limit the maximum amount of rotation of block 82.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An edge connector for receiving a printed circuit board having a mating edge and a plurality of contact pads adjacent the edge, comprising:

an elongated insulating housing having a plurality of contacts mounted on the housing along the length thereof for engaging the printed circuit board contact pads when the printed circuit board is inserted into the housing at a first angular position and subsequently pivoted to a second angular position, the contacts exerting an opposing force against the printed circuit board when in said second angular position;

a latching device having a latching section for engaging the printed circuit board, the latching device being rotatably mounted on the housing for rotation from a first position to a second position in response to pivoting the printed circuit board from said first angular position to said second angular position, the latching device being linearly movable from said second position to a third locking position under the influence of said opposing force of the contacts; and complementary interengaging latching means between the latching device and the housing for locking the printed circuit board to the housing when the latching device moves to said third locking position.

2. The edge connector of claim 1 wherein said latching device comprises a one-piece component.

3. The edge connector of claim 2 wherein said housing is integrally molded of dielectric material, and said complementary interengaging latching means comprise complementary interengaging surfaces on the one-piece latching device and the integral housing.

4. The edge connector of claim 1 wherein said latching device comprises a molded dielectric latching block.

5. The edge connector of claim 4 wherein said housing is integrally molded of dielectric material, and said latching block is rotatable about a pivot post integral with the housing.

6. The edge connector of claim 5 wherein said complementary interengaging latching means comprise complementary interengaging surfaces between the latching block and the pivot post.

7. The edge connector of claim 6 wherein said latching block includes an aperture for receiving the pivot post and said complementary interengaging surface means are located on the interior of said aperture and on the outside of said pivot post.

8. The edge connector of claim 7 wherein said aperture is elongated with a rounded pivot section at one end and a locking surface section at an opposite end, and said pivot post has a rounded portion on one side thereof for rotating in the rounded pivot section of the aperture when the latching block moves between said first and second positions and a locking surface portion on an opposite side thereof for engaging the locking surface section of the aperture when the latching block is in said third locking position.

9. The edge connector of claim 1, including a pair of said latching devices and said complementary interengaging latching means, one at each opposite end of the elongated housing for engaging opposite ends of the printed circuit board.

10. The edge connector of claim 9 wherein said latching devices are identical.

11. An edge connector for receiving a printed circuit board having a mating edge and a plurality of contact pads adjacent the edge, comprising;

an elongated housing integrally molded of dielectric material and including a plurality of spring contacts mounted on the housing along the length thereof for engaging the printed circuit board contact pads when the printed circuit board is inserted into the housing at a first angular position and subsequently pivoted to a second angular position, the spring contacts exerting an opposing force against the printed circuit board when pivoted to said second angular position, the housing including a pair of pivot posts molded integral therewith at opposite ends thereof;

a one-piece latching block rotatably mounted on each said pivot post, each latching block having a latching section for engaging the printed circuit board, each latching block being rotatably mounted on the pivot posts for rotation from a first position to a second position in response to pivoting the printed circuit board from said first angular position to said second angular position, the latching blocks being linearly movable from said second position to a third locking position under the influence of said opposing force of the spring contacts; and complementary interengaging latching surface means between each latching block and its respective pivot post for automatically locking the printed circuit board to the housing when the latching blocks move to said third locking position.

12. The edge connector of claim 11 wherein said opposing force of the spring contacts rotates said printed circuit board to a third position intermediate said first and second board positions, said rotation of the board from said second position to said third position providing the force to linearly move the latching block from its second position to its third position.

13. The edge connector of claim 11 wherein each said latching block includes an aperture for receiving the pivot post and said complementary interengaging surface means are located on the interior of said aperture and on the outside of said pivot post.

14. The edge connector of claim 13 wherein said aperture is elongated with a rounded pivot section at one end and a locking surface section at an opposite end, and said pivot post has a rounded portion on one side thereof for rotating in the rounded pivot section of the aperture when the latching block moves between said first and second positions and a locking surface portion on an opposite side thereof for engaging the locking surface section of the aperture when the latching block is in said third locking position.

15. An edge connector for receiving a printed circuit board having a mating edge and a plurality of contact pads adjacent the edge, comprising:

an elongated insulating housing have a plurality of spring contacts mounted on the housing along the length thereof for engaging the printed circuit board contact pads when the printed circuit board is inserted into the housing at a first angular position and subsequently pivoted to a second angular position, the spring contacts exerting an opposing force against the printed circuit board when pivoted to said second angular position;

a pivot post projecting from at least one end of the elongated housing;

a latching block having a latching section for engaging the printed circuit board, the latching block including an aperture for receiving the pivot post to rotatably mount the latching block on the housing for rotation from a first position to a second position in response to pivoting the printed circuit board from said first angular position to said second angular position; and means for releasably retaining said latching block at said second angular position.

16. The edge connector of claim 15 wherein said releasably retaining means comprises a resilient member engaging a rigid member to prevent rotation of said latching block.

17. The edge card connector of claim 15 wherein the latching block is linearly moveable relative to the pivot post from said second position to a third locking position under the influence of said opposing force of the spring contacts, and further comprises complementary interengaging surface means located on the interior of the aperture in the latching block and on the outside of the pivot post for automatically locking the printed circuit board relative to the housing when the latching block moves to said third locking position.

18. The edge connector of claim 17 wherein said aperture is elongated with a rounded pivot section at one end and a locking surface section at an opposite end, and said pivot post has a rounded portion on one side thereof for rotating in the rounded pivot section of the aperture when the latching block moves between said first and second positions and a locking surface portion on an opposite side thereof for engaging the locking surface section of the aperture when the latching block is in said third locking position.

* * * * *